United States Patent [19]

Hirokazu et al.

[11] Patent Number: 4,576,686

[45] Date of Patent: Mar. 18, 1986

[54] PROCESS FOR PRODUCING ALUMINUM SUPPORT FOR LITHOGRAPHIC PRINTING PLATES

[75] Inventors: Sakaki Hirokazu; Kazushige Takizawa, both of Shizuoka, Japan

[73] Assignee: Fuji Photo Film Co., Ltd., Kanagawa, Japan

[21] Appl. No.: 654,696

[22] Filed: Sep. 26, 1984

[30] Foreign Application Priority Data

Sep. 27, 1983 [JP] Japan ..... 58-178756

[51] Int. Cl.[4] ..... C25D 11/16; C25F 3/04

[52] U.S. Cl. ..... 204/33; 204/129.43; 204/129.75

[58] Field of Search ..... 204/129.75, 129.4, 129.43, 204/33

[56] References Cited

U.S. PATENT DOCUMENTS

| | | | |
|---|---|---|---|
| 3,887,447 | 6/1975 | Sheasby | 204/129.75 |
| 4,072,589 | 2/1978 | Golda | 204/129.75 |
| 4,087,341 | 5/1978 | Takahashi | 204/129.75 |
| 4,294,672 | 10/1981 | Ohba | 204/129.43 |
| 4,468,295 | 8/1984 | Pliefke | 204/129.75 |
| 4,476,006 | 10/1984 | Ohba | 204/129.4 |
| 4,502,925 | 3/1985 | Walls | 204/33 |

*Primary Examiner*—T. M. Tufariello

*Attorney, Agent, or Firm*—Sughrue, Mion, Zinn, Macpeak & Seas

[57] ABSTRACT

A process for producing an aluminum support for a lithographic printing plate is described, comprising a step of electrolytically graining the surface of an aluminum plate in an aqueous solution of electrolyte comprising hydrochloric acid and nitric acid in a ratio by weight from 1/1 to 1/3.5 by applying an electric current having an asymmetrical alternating wave form.

20 Claims, 10 Drawing Figures

10μ

10μ

10μ

10μ

10μ

10μ

10μ

PROCESS FOR PRODUCING ALUMINUM SUPPORT FOR LITHOGRAPHIC PRINTING PLATES

FIELD OF THE INVENTION

The present invention relates to a process for producing an aluminum support for lithographic printing plates, and particularly to a process for producing an aluminum support for lithographic printing plates having a characteristic step in the manner of graining the surface.

BACKGROUND OF THE INVENTION

Hitherto, various processes for graining the surface of an aluminum plate composed of aluminum or aluminum alloy suitable for use as a support for lithographic printing plates have been known. For example, there are mechanical graining processes such as a ball graining, wire graining, brush graining, etc., chemical graining processes, and electrochemical processes such as an electrolytic graining process. After the surface of the aluminum is subjected to graining processing by one or a combination of these graining processes so as to form a roughened surface, it is etched with an aqueous solution of acid or alkali. After it is subjected to anodic oxidation, it is processed, if desired, so as to have a hydrophilic property to produce an aluminum support for lithographic printing plates.

On the resulting support, a lithographically suitable light-sensitive layer is provided to produce a light-sensitive lithographic printing plate (the so-called PS (Pre-Sensitized) plate). This PS plate is generally subjected to steps of imagewise exposure, development, retouching and gumming, etc., to produce a lithographic printing plate, which is then placed on a printing machine to carry out printing.

It must be noted that the graining of the surface of the aluminum plates by the above-described mechanical graining processes does not bring about satisfactory results in many uses for lithographic printing, because a comparatively coarse and unevenly grained surface is formed.

On the other hand, according to the electrolytic graining process, the same grained surface as that in case of mechanical graining is formed during electrolytic processing. However, if the electrolytic processing is continued, secondary pits are formed in the first-formed primary pits, to obtain an aluminum plate having the so-called double-structure or pits-in-pit grained surface. Accordingly, the lithographic printing plate using such an aluminum plate as a support is unsatisfactory in press life of the plate, or is unsatisfactory from the viewpoint that the non-image area is easily contaminated, although it does have a remarkably improved printing performance. In addition, it has the fault that production thereof consumes large electricity. Thus, a process wherein formation of primary pits is carried out by mechanical graining and formation of secondary pits is carried out by electrolytic graining has been developed (for example, refer to British Patent No. 2,047,274). In this process, it is necessary that hemispherical pits having a small diameter are formed in high density in the secondary graining step by electrolysis, but sufficiently satisfactory results in press life and contamination have not been obtained, yet.

On the other hand, a process wherein a double structure grained surface is formed solely by the electrolytic graining processing is known. Namely, Japanese Patent Publication 51119/81 has disclosed a process which comprises in a nitric acid type electrolyte forming a primary pit structure by electrolyzing at a high current density as the first step, and forming secondary pits by electrolyzing at a low current density as the second step with a desmutting step therebetween. However, a lithographic printing plate using an aluminum plate grained in such a manner as a support has a disadvantage that the non-image area is easily contaminated.

Moreover, U.S. Pat. No. 4,072,589 has disclosed an electrolytic graining process for an aluminum plate which comprises electrolyzing with an alternating current at a specific current density in an electrolyte containing hydrochloric acid and nitric acid in a ratio by weight of from $\frac{1}{4}$ to 1/6 at 40° C. or more, but there is a problem in that a lithographic printing plate using the resulting aluminum support has inferior press life.

SUMMARY OF THE INVENTION

Accordingly, an object of the present invention is to provide a process for producing a support for lithographic printing plates excellent in both press life and resistance to contamination.

Another object of the present invention is to provide a process for producing an aluminum support for lithographic printing plates having an excellent hydrophilic property, an excellent water retentive property, and long press life, which consumes very little electricity and is economical.

As a result of extensive studies including specific attention to the composition of the electrolyte and the wave form of electric current in order to attain the above-described objects, it has now been found that the above-described objects can be attained by carrying out electrolytic graining of an aluminum plate with an electric current having an asymmetrical alternative wave form in an aqueous solution of electrolyte containing hydrochloric acid and nitric acid in a ratio by weight of 1/1 to 1/3.5.

DETAILED DESCRIPTION OF THE INVENTION

Figure 1A:
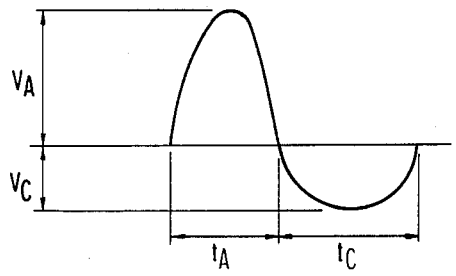
FIG. 1 indicates voltage wave forms of electric currents obtained as alternative wave form elecgric currents, wherein (a) is a sinosoidal wave, (b) is a rectangular wave and (c) is a trapezoidal wave; VA is anode time voltage, VC is cathode time voltage, tA is anode time, and tC is cathode time.

In the following, the process for producing an aluminum support for lithographic printing plates according to the present invention is illustrated in detail.

Aluminum plates which can be used in the present invention include pure aluminum plates and aluminum alloy plates. Various aluminum alloys can be used, for example, aluminum alloys composed of aluminum and metals such as silicon, iron, copper, manganese, magnesium, chromium, zinc, bismuth, nickel, etc., can be used.

In order to remove rolling oils from the surface of an aluminum plate and to expose a cleaned aluminum face, the aluminum plate is subjected, if necessary, to degreasing processing or etching processing prior to carrying out electrolytic graining processing. In order to carry out the former, the surface is cleaned with a solvent such as trichlene, etc., or a surfactant. In order to carry out alkali etching, alkali etching agents such as sodium hydroxide, potassium hydroxide, etc., are widely used. Alkali etching is generally carried out by processing at a liquid temperature of from 40° C. to 100° C. for from 5 to 300 seconds with a 0.05 to 40 weight % aqueous solution. In the case of alkali etching, since smut is generally formed on the surface of aluminum, it is preferred to carry out the so-called desmutting processing with phosphoric acid, nitric acid, sulfuric acid, or chromic acid, or a mixed acid containing two or more of the above-described acids.

The degreased aluminum plate is then subjected to electrolytic graining according to the process of the present invention. The electrolyte solution used in the present invention is an aqueous solution of electrolyte wherein a small but effective amount of hydrochloric acid and a small but effective amount of nitric acid are combined as an active electrolyte; the ratio by weight of the hydrochloric acid to the nitric acid should be in the range of from 1/1 to 1/3.5. If the ratio is outside of this range, the objects of the present invention are not attained. It is found that preferred results are obtained when the hydrochloric acid is present in a concentration of from 2 g/l to 15 g/l, and more preferably from 3 g/l to 10 g/l in the aqueous solution of electrolyte. The nitric acid electrolyte is preferably present in a concentration of from 2 g/l to 53 g/l, and more preferably from 3 g/l to 35 g/l in the aqueous solution of electrolyte. The electrolytic bath is preferred to have a temperature of from about 10° to 60° C., and more preferably from about 15° to 50° C. In the most preferred embodiments of the present invention, the ratio by weight of the hydrochloric acid to the nitric acid is in the range of from 1/2.5 to 1/3.5.

To the electrolyte solution, if necessary, anticorrosive agents (or stabilizers) such as nitrates, chlorides, monoamines, diamines, aldehydes, phosphoric acid, chromic acid, boric acid, etc., can be added.

The electric current having an alternative wave form used in the process for electrolytic graining of the present invention has a wave form wherein the negative and positive polarities alternately exchange, and various wave forms such as sinosoidal wave, rectangular wave, trapezoidal wave or phase control wave, etc., can be used. However, in any case, it should have an asymmetrical wave form. On the contrary, when an electric current having a symmetrical alternating wave form, such as a commercial alternating current, is used, not only is grain formation efficiency inferior, but also lithographic printing plates having long press life are not obtained.

Figure 1B:
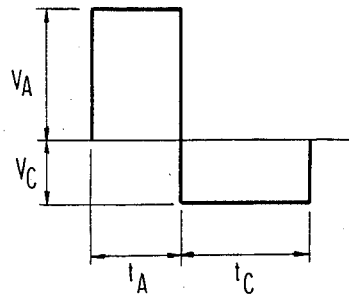
Figure 1C:
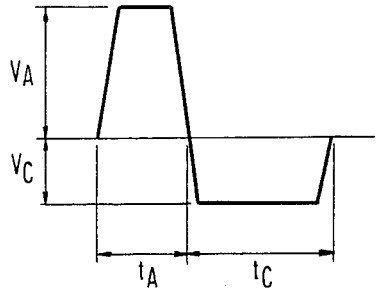

In preferred embodiments of the present invention, an electric current is applied to an aluminum plate in the above-described electrolyte solution so that a ratio (QC/QA) of quantity of cathode time electricity (QC) to quantity of anode time electricity (QA) is from 0.4/1 to 1.25/1. It is particularly preferred to use a process which comprises applying an electric current having an alternating wave form to an aluminum plate at such an electric pressure that anode time voltage is higher than cathode time voltage so that the quantity of anode time electricity is larger than quantity of cathode time electricity, as described in U.S. Pat. No. 4,087,341. FIG. 1 indicates wave form of electric currents having an alternating wave form. In FIG. 1, (a) is an alternating wave form voltage using a sinosoidal wave, (b) is a rectangular wave, and (c) is a trapezoidal wave. Thus, according to the present invention, the wave form is not particularly limited.

The most preferred results can be obtained in practicing the present invention in cases wherein the electrolytic graining processing is carried out under conditions such that the electric voltage applied to the aluminum is from about 1 to 50 V, and preferably is from 2 to 30 V, the current density is from about 10 to 100 A/dm$^2$, and the quantity of electricity is from about 100 to 30,000 coulombs/dm$^2$, and preferably is from 100 to 3,000 coulombs/dm$^2$.

When such conditions are adopted, double-structure grains wherein fine pits (hereinafter referred to as secondary pits) are formed in large deep pits (hereinafter referred to as primary pits) are obtained on the surface of the aluminum. The primary pit is preferred to have a diameter of from 2 to 30 μm and a depth of from 0.1 to 10 μm, and the secondary pit is preferred to have a diameter of from 1 to 3 μm and a depth of from 0.1 to 1 μm.

Contrary to expectations, it has been found that desired advantageous results of the present invention are not obtained when the processing condition is outside of the above-described ranges.

For example, if the ratio of nitric acid to hydrochloric acid is higher than 3.5, the surface of the processed aluminum plate is lustrous and many parts may not be grained. If the ratio of nitric acid to hydrochloric acid is less than 1, though the surface of the processed aluminum plate is uniformly grained, double-structure grains are not formed, because large deep pits are not formed.

Since smut is formed on the aluminum face which was subjected to electrolytic graining processing, desmutting processing is generally carried out after washing with water, in order to remove smut. This desmutting processing is carried out by bringing the surface of the aluminum plate into contact with an aqueous solution of acid or alkali, for example, by immersion processing, etc. Examples of the acid include phosphoric acid, sulfuric acid and chromic acid. As the alkali, the same substance as that in case of the above-described chemical etching processing can be used. Of these, particularly suitable desmutting processing includes a process of bringing into contact with sulfuric acid from 15 to 65% by weight at a temperature of from 50° to 90° C. as described in Japanese Patent Publication 11316/81 and a process of alkali etching as described in Japanese Patent Publication 28123/73.

The aluminum sheet processed as described above is preferred to be subsequently subjected to anodic oxidation processing. The anodic oxidation processing can be carried out by an anodic processes utilized hitherto in this field of the art. For example, an anodic oxidation film can be formed on the surface of the aluminum plate by applying a direct current or an alternating current to the aluminum plate in an aqueous solution or nonaqueous solution of sulfuric acid, phosphoric acid, chromic acid, oxalic acid, sulfamic acid, benzenesulfonic acid, etc., or a combination of two or more of them.

Processing conditions for anodic oxidation cannot be generally determined, because they depend upon the electrolyte used. However, it is generally preferred to use a concentration of electrolyte of from 1 to 80% by weight, a liquid temperature of from 5° to 70° C., a current density of from 0.5 to 60 amperes/dm$^2$, a voltage of from 1 to 100 V and an electrolysis time of from 10 seconds to 50 minutes.

Of these anodic oxidation processings, a process of carrying out anodic oxidation in sulfuric acid at a high current density described in British Patent No. 1,412,768 and a process of carrying out anodic oxidation in phosphoric acid as an electrolytic bath described in U.S. Pat. No. 3,511,661 are particularly preferable.

The anodic oxidation aluminum plate may be further processed by immersing in an aqueous solution of alkali metal silicate (for example, sodium silicate) as described in U.S. Pat. Nos. 2,714,066 and 3,181,461, or processed with an aqueous solution of organic phosphonic acid (for example, polyvinylphosphonic acid) as described in U.S. Pat. No. 3,220,832, or an undercoating layer of hydrophilic cellulose (for example, carboxymethyl cellulose, etc.) containing water-soluble metal salts (for example, zinc acetate, etc.) may be provided on the anodic oxidation aluminum plate as described in U.S. Pat. No. 3,860,426.

To the resulting support for lithographic printing plates, a light-sensitive layer known hitherto as a light-sensitive layer for PS plates is applied to obtain a light-sensitive lithographic printing plate. A lithographic printing plate obtained by plate making thereof has excellent performance.

As a composition for the above-described light-sensitive layer, a composition generally can be used if the solubility or swelling property of it in a developing solution changes upon exposure. In the following, typical examples of it are illustrated.

(1) A light-sensitive composition comprising an o-quinonediazide compound

As positive type light-sensitive diazo compounds, esters of benzoquinone-1,2-diazidosulfonic acid chloride and polyhydroxyphenyl and ester of naphthoquinone-1,2-diazidosulfonic acid chloride and pyrogallolacetone resin described in U.S. Pat. No. 3,635,709 are most suitably used. As other relatively useful o-quinonediazide compounds, there are esters of benzoquinone-1,2-diazidosulfonic acid chloride or naphthoquinone-1,2-diazidosulfonic acid chloride and phenolformaldehyde resin described in U.S. Pat. No. 3,046,120 and 3,188,210.

The o-quinonediazide compounds by themselves form a light-sensitive layer, but they can also be used together with resins soluble in aqueous alkali solution as binders. Resins soluble in aqueous alkali solution include novolak resins having such a property. For example, there are phenol-formaldehyde resins, cresolformaldehyde resins, p-t-butylphenol-formaldehyde resins, phenol modified xylene resins and phenol modified xylenemesitylene resins, etc. Examples of other available resins soluble in aqueous alkali solution include polyhydroxystyrene and copolymers of polyhalogenated hydroxystyrene acrylic (methacrylic) acid and other vinyl compounds.

Light-sensitive layers comprising o-quinonediazide compounds and developing solutions therefor are described in further detail in U.S. Pat. No. 4,259,434.

(2) A light-sensitive composition composed of diazo resin and a binder

As negative type light-sensitive diazo compounds, condensation products of diphenylamine-p-diazonium salt and formaldehyde (the so-called light-sensitive diazo resins) which are reaction products of a diazonium salt and an organic condensing agent having a reactive carbonyl group such as aldol or acetal, described in U.S. Pat. Nos. 2,063,631 and 2,667,415 are preferably used. Other available condensation diazo compounds have been disclosed in British Patent Nos. 1,312,925 and 1,312,926 and U.S. Pat. No. 3,679,419, etc. These types of light-sensitive diazo compound are generally obtained as a form of water-soluble inorganic salts, and, consequently, they can be applied in the state of aqueous solution. Further, these water-soluble diazo compounds can be used as substantially water-insoluble light-sensitive diazo resins by reactint them with an aromatic or aliphatic compound having 1 or more phenolic hydroxyl groups, sulfonic acid groups or both of them by the process disclosed in British Patent No. 1,280,855.

Further, they can be used as reaction products with hexafluorophosphate or tetrafluoroborate, as described in Japanese Patent Application No. (OPI) 121031/81 (the term "OPI" as used herein refers to a "published unexamined Japanese patent application").

In addition, diazo resins as described in U.S. Pat. No. 1,312,925 are preferred.

These diazo resins are used together with binders. Preferred binders are organic high polymers having an acid value of from 10 to 200. Examples thereof include copolymers containing acrylic acid, methacrylic acid, crotonic acid or maleic acid as an essential monomer component, copolymers of 2-hydroxyethyl acrylate or 2-hydroxyethyl methacrylate, acrylonitrile or methacrylonitrile, acrylic acid or methacrylic acid, and, if desired, another copolymerizable monomer, as described in U.S. Pat. No. 4,123,276, copolymers of acrylic or methacrylic acid esterified with a group containing a terminal hydroxyl group and a dicarboxylic acid ester residue, acrylic acid or methacrylic acid, and, if desired, another copolymerizable monomer, as described in Japanese Patent No. Application No. (OPI) 120903/78, copolymers of a monomer having a terminal aromatic hydroxyl group (for example, N-(4-hydroxyphenyl)methacrylamide, etc.), acrylic acid or methacrylic acid, and, if desired, at least one other copolymerizable monomer, as described in Japanese Patent Application No. (OPI) 98614/79, and copolymers of alkyl acrylate or methacrylate, acrylonitrile or methacrylonitrile, and unsaturated carboxylic acid, as described in Japanese Patent Application No. (OPI) 4144/81. Further, acid polyvinyl alcohol derivatives and acid cellulose derivatives can also be used.

(3) Composition containing a compound which undergoes dimerization by irradiation of active rays Examples of these compounds include polyvinylcinnamate, polyvinylcinnamoyl ethyl ether, polyethyl cinnamate acrylate and copolymers thereof, polyethylcinnamate methacrylate and copolymers thereof, poly-p-vinylphenylcinnamate and copolymers thereof, polyvinylbenzalacetophenone and derivatives thereof, polyvinylcinnamylidene acetate and derivatives thereof, allyl acrylate prepolymers and derivatives thereof, and derivatives of polyester resin composed of p-phenylenediacrylic acid and polyhydric alcohol, for example, compounds described in U.S. Pat. No. 3,030,208, etc.

(4) Light-polymerizable composition which undergoes a polymerization reaction by irradiation of active rays Examples are compositions composed of an addition polymerizable unsaturated compound having a terminal ethylene group and a light-polymerization initiator, as described in U.S. Pat. Nos. 2,760,863 and 3,060,023.

To the above-described compounds which undergo dimerization or a polymerization reaction by irradiation of active rays, it is possible to add resins as a binder, sensitizers, thermal polymerization inhibitors, dyes and plasticizers, etc.

The above-described light-sensitive composition is applied generally as a solution in water, an organic solvent or a mixture thereof, to a support according to the present invention, and dried to produce a light-sensitive printing plate.

The light-sensitive composition is generally applied in an amount of from about 0.1 to about 5.0 g/m$^2$, and preferably from about 0.5 to about 3.0 g/m$^2$.

The resulting light-sensitive lithographic printing plate is imagewise exposed to light by a light source containing active rays, such as a carbon arc lamp, a xenon lamp, a mercury lamp, a tungsten lamp, a metal halide lamp, etc., and developed to obtain a lithographic printing plate.

The lithographic printing plate using an aluminum support obtained by the present invention shows remarkable effects that it has longer press life as compared with the prior art, and the non-image area is not easily contaminated. Hitherto, lithographic printing plates having long press life have had the fault that the non-image area was easily contaminated, and, conversely, lithographic printing plates having a non-image area which is not easily contaminated have had the problem that the press life thereof is inferior. Therefore, it has been believed that it is very difficult to improve both of these performances at the same time.

However, the lithographic printing plates using the aluminum support produced by the present invention have excellent properties, in that they have long press life and the non-image area is not easily contaminated, which could not be obtained in the prior art.

Further, the process of the present invention is economically advantageous, because the desired grains can be formed with a small quantity of electricity as compared with prior processes for electrolytic graining.

In the following, the present invention is illustrated in greater detail by reference to examples. In examples, unless otherwise stated, "%" means "% by weight".

EXAMPLE 1

An aluminum alloy rolling plate (JIS 1050-H18) having a thickness of 0.24 mm was immersed in a 10% aqueous solution of sodium hydroxide at 60° C. for 20 seconds to expose the cleaned aluminum face, and thereafter after was subjected to desmutting processing with a 30% aqueous solution of nitric acid.

The resulting base plate was subjected to electrolytic graining processing with an alternating wave form current using a rectangular wave shown in FIG. 1 (b) by immersing in an aqueous solution of electrolyte containing hydrochloric acid (3.3 g/l)/nitric acid (10 g/l)=$\frac{1}{3}$. The electrolysis was carried out under a condition of anode time current density=DA: 35 A/dm$^2$, quantity or anode time electricity QA=400 coulombs/dm$^2$, and the ratio of quantity of cathode time electricity to quantity of anode time electricity=0.90. After washed with water, it was processed in a 10% aqueous solution of sodium hydroxide to completely dissolve smut.

By the same manner as described above, Sample B was prepared by electrolytic graining in an aqueous solution of electrolyte having hydrochloric acid (5 g/l) / nitric acid (10 g/l)=$\frac{1}{2}$. For comparison, Sample C, Sample D, Sample E and Sample F were prepared by electrolytic graining processing in aqueous solutions of electrolyte having a hydrochloric acid (2.5 g/l)/nitric acid (10 g/l) ratio of $\frac{1}{4}$, a hydrochloric acid (14.3 g/l)/nitric acid (10 g/l) ratio of 1/0.7, a nitric acid: 10 g/l, and hydrochloric acid: 5 g/l, respectively, and Sample G was prepared by electrolytic graining processing using a commercial symmetric alternating current in an aqueous solution of electrolyte having a hydrochloride (3.3 g/l)/nitric acid (10 g/l)=$\frac{1}{3}$.

Each sample was then subjected to anodic oxidation in a 10% aqueous solution of sulfuric acid to form an oxide film of 3 g/m$^2$.

To each sample produced as described above, a light-sensitive layer having the following formulation was applied so as to result in a dried coating amount of 2.5 g/m$^2$.

| Formulation (I) | |
|---|---|
| Esterified product of naphthoquinone-1,2-diazide-5-sulfonyl chloride and pyrogallol-acetone resin (substance described in Example 1 in U.S. Pat. No. 3,635,709) | 0.75 g |
| Cresol-novolak resin | 2.00 g |
| Oil Blue #603 (oil-soluble blue dye, produced by Oriental Chemical) | 0.04 g |
| Ethylenedichloride | 16 g |
| 2-Methoxyethyl acetate | 12 g |

After light-sensitive lithographic printing plates produced as described above were exposed to light for 50 seconds by a 3 KW metal halide lamp at a distance of 1 m through a positive transparency in a vacuum printing frame, they were developed with a 5.26% aqueous solution of sodium silicate having a molar ratio of $SiO_2$/-$Na_2O$ being 1.74 (pH=12.7), followed by gumming with an aqueous solution of gum arabic.

When printing was carried out using the resulting lithographic printing plates by means of an offset printing machine according to the conventional manner, the results shown in Table 1 were obtained. In Table 1, contamination resistance was evaluated by a degree of generation of contamination under variation of press conditions, e.g., the amount of dampening water, the tackiness of ink, etc., and represented by the following evaluation.

Excellent: Generation of contamination under variation of press condition was not seen.

Inferior: Generation of contamination under a slight variation of press condition was seen.

The state of the surface is shown by scanning electron microphotographs.

TABLE 1

Figure 2:
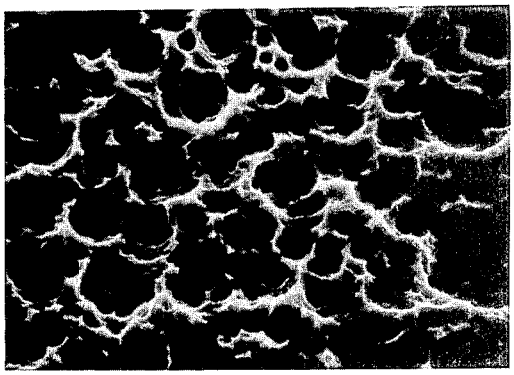
FIGS. 2 to 8 indicate electron micrographs of aluminum surfaces which were subjected to electrolytic graining processing under varying ratios of hydrochloric acid to nitric acid.
Figure 3:
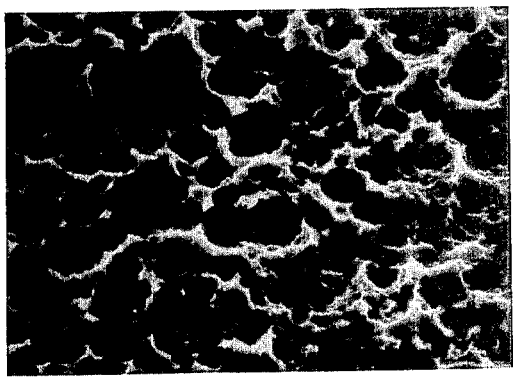
Figure 4:
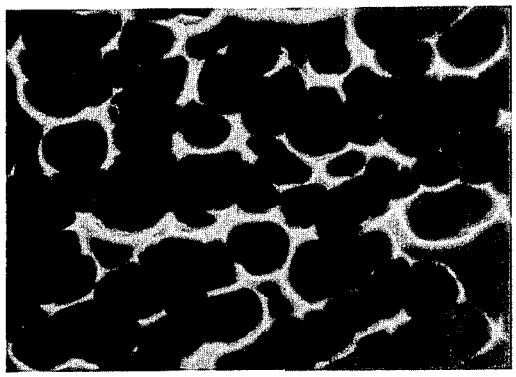
Figure 5:
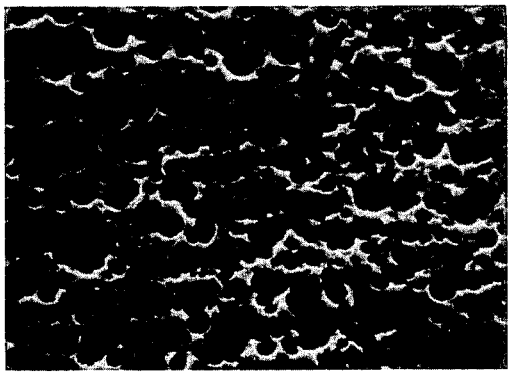
Figure 6:
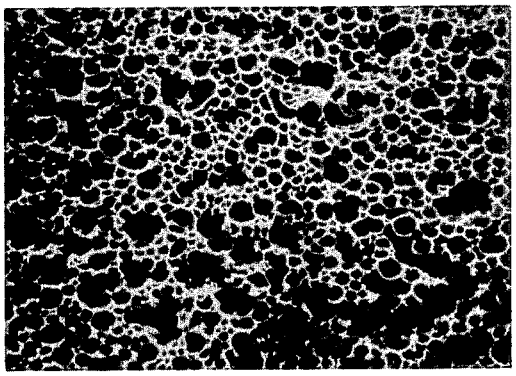
Figure 7:
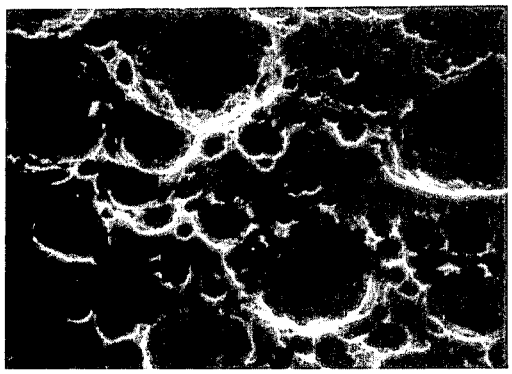
Figure 8:
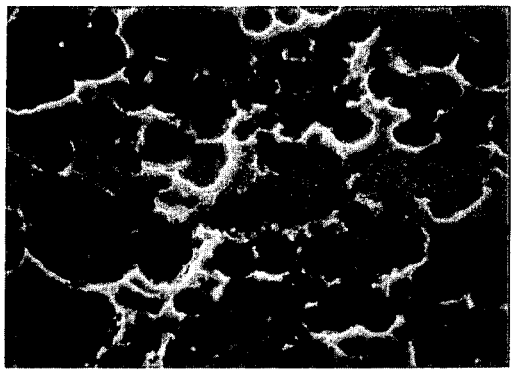

| | Examples | | Comparative Examples | | | | |
|---|---|---|---|---|---|---|---|
| | Sample A | Sample B | Sample C | Sample D | Sample E | Sample F | Sample G |
| Formulation of electrolyte | | | | | | | |
| HCl (g/l) | 3.3 | 5 | 2.5 | 14.3 | — | 5 | 3.3 |
| $HNO_3$ (g/l) | 10 | 10 | 10 | 10 | 10 | — | 10 |
| $HCl/HNO_3$ | $\frac{1}{3}$ | $\frac{1}{2}$ | $\frac{1}{4}$ | 1/0.7 | — | — | $\frac{1}{3}$ |
| Electrolysis condition | | | | | | | |
| Temperature of bath (°C.) | 50 | 50 | 50 | 50 | 50 | 50 | 50 |
| Current density $D_A$ ($A/dm^2$) | 35 | 35 | 35 | 35 | 35 | 35 | 35 |
| Quantity of electricity $Q_A$ ($coulombs/dm^2$) | 400 | 400 | 400 | 400 | 400 | 400 | 400 |
| $Q_C/Q_A$ | 0.90 | 0.90 | 0.90 | 0.90 | 0.90 | 0.90 | 1.0 |
| Anodic oxidation film (μ) | 1 | 1 | 1 | 1 | 1 | 1 | 1 |
| Average surface roughness (m) | 0.68 | 0.65 | 0.52 | 0.25 | 0.31 | 0.45 | 0.42 |
| State of surface | FIG. 2 | FIG. 3 | FIG. 4 | FIG. 5 | FIG. 6 | FIG. 7 | FIG. 8 |
| Contamination resistance | Excellent | Excellent | Excellent | Inferior | Inferior | Excellent | Excellent |
| Press life | 200,000 | greater than 200,000 | 80,000 | 150,000 | 150,000 | 100,000 | 120,000 |

In Sample A and Sample B of the examples, double structure grains were formed as shown in FIG. 2 and FIG. 3, and excellent results in resistance to contamination and press life were obtained. On the other hand, in Sample C and Sample D which were processed with electrolytes having the formulation of hydrochloric acid/nitric acid of $\frac{1}{4}$ and hydrochloric acid/nitric acid of 1/0.7, respectively, large deep pits were formed, but fine pits were not formed therein, and press life was extremely inferior. Further, in Sample D and Sample E which were processed with electrolytes having the formulation of hydrochloric acid/nitric acid of 1/0.7 and nitric acid of 10 g/l, respectively, large deep pits were not formed, while fine pits were formed, the average surface roughness was small, and both contamination resistance and press life were inferior.

In Sample G using commercial alternating current, the grains were not uniform and the press life was inferior.

EXAMPLE 2

An aluminum alloy rolling plate (JIS 1050-H18) having a thickness of 0.24 mm was immersed in a 10% aqueous solution of sodium hydroxide at 60° C. for 20 seconds to expose the cleaned aluminum face, and thereafter was subjected to desmutting processing with a 30% aqueous solution of nitric acid.

Thus resulted base plate was subjected to electrolytic graining processing in aqueous solutions of electrolyte containing: HCl (5.7 g/l)/$HNO_3$ (20 g/l)=1/3.5, HCl (20 g/l)/$HNO_3$ (20 g/l)=1/1, and HCl (3.3 g/l)/$HNO_3$ (20 g/l)=1/6 under the same electrolysis conditions as in Example 1, and was then subjected to anodic oxidation processing in the same manner as in Example 1 to prepare Sample H, Sample I, and Sample J.

Each sample prepared as described above was immersed in a 2% aqueous solution of sodium silicate at 70° C. for 1 minute. After washing with water and drying, the following composition for the light-sensitive layer was applied and dried to provide a light-sensitive layer of 1.5 $g/m^2$.

| Composition for Light-Sensitive Layer: | |
|---|---|
| N—(4-Hydroxyphenyl)methacrylamide/2-hydroxyethyl methacrylate/acrylonitrile/methyl methacrylate/methacrylic acid (molar ratio: 15:10:30:38:7) (average molecular weight: 60,000) | 5.0 g |
| Hexafluorophosphate of a condensation product of 4-diazodiphenylamine and formaldehyde | 0.5 g |
| Phosphorous acid | 0.05 g |
| Victoria pure Blue BOH (produced by Hodogaya Chemical Co.) | 0.1 g |
| 2-Methoxyethanol | 100 g |

After light-sensitive lithographic printing plates produced as described above were exposed to light for 50 seconds by 3 KW metal halide lamp at a distance of 1 m through a transparent negative film in a vacuum printing frame, they were developed with a developing solution having the following formulation, followed by gumming with an aqueous solution of gum arabic to obtain lithographic printing plates.

| Developing Solution: | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1,000 g |

Using these printing plates, printing tests were carried out by means of an offset rotary press. The results obtained are shown in Table 2.

TABLE 2

| | Example | | Comparative Example |
|---|---|---|---|
| | Sample H | Sample I | Sample J |
| Formulation of electrolyte | | | |
| HCl (g/l) | 5.7 | 20 | 3.3 |
| $HNO_3$ (g/l) | 20 | 20 | 20 |
| $HCl/HNO_3$ | 1/3.5 | 1/1 | 1/6 |
| Electrolysis condition | | | |
| Temperature of bath (°C.) | 50 | 50 | 50 |
| Current density $D_A$ ($A/dm^2$) | 35 | 35 | 35 |
| Quantity of electricity $Q_A$ ($coulombs/dm^2$) | 400 | 400 | 400 |
| $Q_C/Q_A$ | 0.9 | 0.9 | 0.9 |
| Anodic oxidation film (μ) | 1 | 1 | 1 |
| Average surface roughness | 0.59 | 0.56 | 0.55 |
| Contamination resistance | Excellent | Excellent | Excellent |
| Press life | 250,000 | 250,000 | 100,000 |

In Sample G and Sample H of the examples, excellent results in contamination resistance and press life were obtained. In Sample I which was grained with an aqueous solution of electrolyte having $HCl/HNO_3=1/6$, the press life was extremely inferior.

While the invention has been described in detail and with reference to specific embodiments thereof, it will be apparent to one skilled in the art that various changes and modifications can be made therein without departing from the spirit and scope thereof.

What is claimed is:

1. A process for producing an aluminum support for a lithographic printing plate, comprising a step of electrolytically graining the surface of an aluminum plate in an aqueous solution of electrolyte comprising hydrochloric acid and nitric acid in a ratio by weight of from 1/1 to 1/3.5 by applying an electric current having an asymmetrical alternating wave form.

2. A process according to claim 1, wherein the ratio of quantity of cathode time electricity to quantity of anode time electricity (QC/QA) of said electric current having an asymmetrical alternating wave form is from 0.4/1 to 1.25/1.

3. A process according to claim 1, wherein the surface is further subjected to anodic oxidation.

4. A process according to claim 1, wherein the ratio by weight of the hydrochloric acid to the nitric acid is from 1/2.5 to 1/3.5.

5. A process according to claim 2, wherein the ratio by weight of the hydrochloric acid to the nitric acid is from 1/2.5 to 1/3.5.

6. A process according to claim 1, wherein the hydrochloric acid is present in a concentration of from 2 g/l to 15 g/l, the nitric acid concentration is from 2 g/l to 53 g/l, and the electrolytic graining is conducted at a temperature of from about 10° to 60° C.

7. A process according to claim 4, wherein the hydrochloric acid is present in a concentration of from 2 g/l to 15 g/l, the nitric acid concentration is from 2 g/l to 53 g/l, and the electrolytic graining is conducted at a temperature of from about 10° to 60° C.

8. A process according to claim 5, wherein the hydrochloric acid is present in a concentration of from 2 g/l to 15 g/l, the nitric acid concentration is from 2 g/l to 53 g/l, and the electrolytic graining is conducted at a temperature of from about 10° to 60° C.

9. A process according to claim 1, wherein the hydrochloric acid is present in a concentration of from 3 g/l to 10 g/l, the nitric acid concentration is from 3 g/l to 35 g/l, and the electrolytic graining is conducted at a temperature of from about 15° to 50° C.

10. A process according to claim 4, wherein the hydrochloric acid is present in a concentration of from 3 g/l to 10 g/l, the nitric acid concentration is from 3 g/l to 35 g/l, and the electrolytic graining is conducted at a temperature of from about 15° to 50° C.

11. A process according to claim 5, wherein the hydrochloric acid is present in a concentration of from 3 g/l to 10 g/l, the nitric acid concentration is from 3 g/l to 35 g/l, and the electrolytic graining is conducted at a temperature of from about 15° to 50° C.

12. A process according to claim 1, wherein the electrolytic graining is carried out at a voltage of from 1 to 50 V, a current density of from about 10 to 100 $A/dm^2$, and the quantity of electricity is from about 100 to 30,000 $coulombs/dm^2$.

13. A process according to claim 4, wherein the electrolytic graining is carried out at a voltage of from 1 to 50 V, a current density of from about 10 to 100 $A/dm^2$, and the quantity of electricity is from about 100 to 30,000 $coulombs/dm^2$.

14. A process according to claim 5, wherein the electrolytic graining is carried out at a voltage of from 1 to 50 V, a current density of from about 10 to 100 $A/dm^2$, and the quantity of electricity is from about 100 to 30,000 $coulombs/dm^2$.

15. A process according to claim 3, wherein the ratio of quantity of cathode time electricity to quantity of anode time electricity (QC/QA) of said electric current having an asymmetrical alternating wave form is from 0.4/1 to 1.25/1.

16. A process according to claim 3, wherein the ratio by weight of the hydrochloric acid to the nitric acid is from 1/2.5 to 1/3.5.

17. A process according to claim 15, wherein the ratio by weight of the hydrochloric acid to the nitric acid is from 1/2.5 to 1/3.5.

18. A lithographic support produced by the process of claim 1.

19. A lithographic support produced by the process of claim 3.

20. A process for producing an aluminum support for a lithographic printing plate as defined in claim 1, wherein the electric current having an asymmetrical alternating wave form does not include an intermission of zero voltage, in at least one of the anode or cathode phases.

* * * * *